United States Patent [19]

Pyliotis

[11] Patent Number: 4,624,182

[45] Date of Patent: Nov. 25, 1986

[54] DEVICE FOR DAMPENING A PRINTING PLATE

[75] Inventor: Dimitrios Pyliotis, Leimen, Fed. Rep. of Germany

[73] Assignee: Heidelberger Druckmaschinen AG, Heidelberg, Fed. Rep. of Germany

[21] Appl. No.: 633,121

[22] Filed: Jul. 20, 1984

[30] Foreign Application Priority Data

Jul. 23, 1983 [DE] Fed. Rep. of Germany ..... 3326699

[51] Int. Cl.[4] ..... B41L 25/04; B41L 41/00

[52] U.S. Cl. ..... 101/147; 101/425; 101/416 A

[58] Field of Search ..... 101/148, 147, 350, 132.5, 101/133, 134.5, DIG. 24, 416 A, 451, 425

[56] References Cited

U.S. PATENT DOCUMENTS

| | | | |
|---|---|---|---|
| 176,193 | 4/1876 | Rhell | 101/148 |
| 1,364,257 | 1/1921 | Dobberton | 101/148 |
| 2,162,248 | 6/1939 | Delaplane | 101/148 |
| 2,580,667 | 1/1952 | Faeber et al. | 101/148 |
| 2,804,693 | 9/1957 | Brodie | 101/148 X |
| 3,106,154 | 10/1963 | Saul | 101/148 |
| 3,257,940 | 6/1966 | Strudwick | 101/148 |
| 3,343,484 | 9/1967 | Dahlgren | 101/148 |
| 4,143,596 | 3/1979 | Ivett | 101/148 |

FOREIGN PATENT DOCUMENTS

| | | | |
|---|---|---|---|
| 549437 | 3/1931 | Fed. Rep. of Germany | 101/147 |
| 548280 | 4/1932 | Fed. Rep. of Germany | 101/167 |
| 107837 | 7/1982 | Japan | 101/148 |
| 362131 | 12/1931 | United Kingdom | 101/148 |

*Primary Examiner*—Edgar S. Burr
*Assistant Examiner*—James R. McDaniel
*Attorney, Agent, or Firm*—Herbert L. Lerner; Laurence A. Greenberg

[57] ABSTRACT

A device for dampening a printing plate of a rotary printing machine having in successive engagement a dampening-pan roller, a metering roller and dampening-medium applicator rollers for forming a very thin uniform dampening-medium film including at least one brush roller cooperatively engaging and rolling on the metering roller, the brush-roller having absorptive brushes on the periphery thereof engageable with the surface of the metering roller for removing at least part of the dampening medium located in excessive quantities at any surface region of the metering roller.

3 Claims, 2 Drawing Figures

DEVICE FOR DAMPENING A PRINTING PLATE

Figure 1:
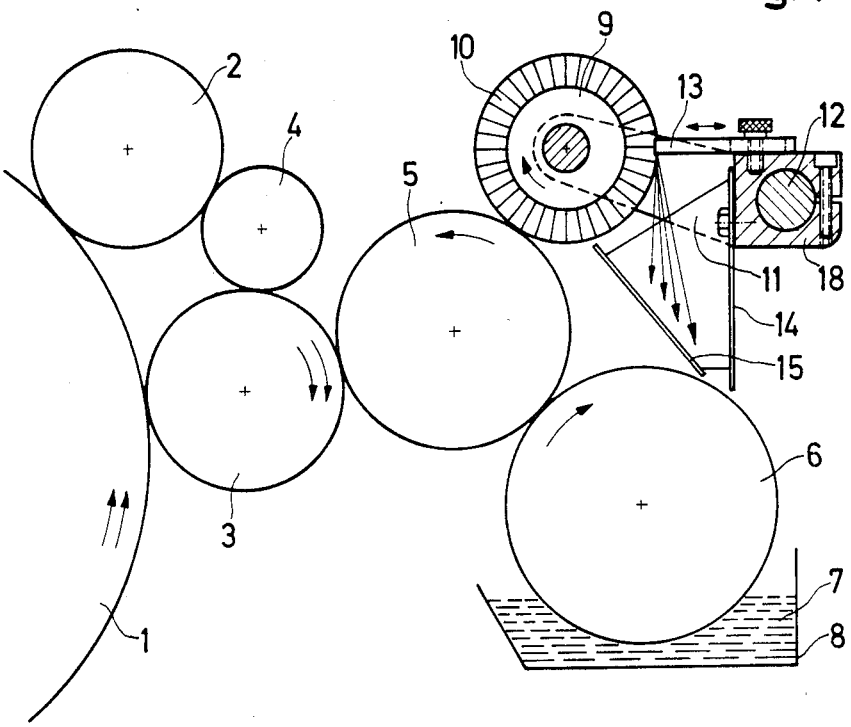

The invention relates to a device for dampening a printing plate of a rotary printing machine and more particularly to such a device having in successive engagement, a dampening-pan roller, a metering roller and dampening-medium applicator rollers.

Such so-called dampening units are, of course, known and serve for dampening or wetting the printing plate with a uniformly thin dampening-medium film before ink is applied thereto. In this regard, an effort is made to apply the dampening-medium film as thin as possible in order to prevent any change in the material being printed on and, nevertheless, achieve a flawless printed image. The latitude or tolerance available for this purpose is very small, so that great demands are made upon modern dampening units.

Although it is possible to apply a uniform and very thin dampening-medium film over the length of the plate cylinder with modern dampening units, an excessive supply of dampening medium does get delivered in some areas in the case of certain specific types of presswork. This is true, for example, if less dampening medium is required in a given area than over the areas of the plate because of specific characteristics of the printed image which is to be formed. Once this is apparent or visible in the printed image to the expert, the problem arises of reducing the supplied dampening medium in the area to some extent.

It is accordingly an object of the invention to provide a device for dampening a printing plate which, even for very small quantities of dampening medium, achieves a highly sensitive metering of dampening medium in specific areas of the printing plate without any excessive technical outlay.

With the foregoing and other objects in view, there is provided in accordance with the invention, a device for dampening a printing plate of a rotary printing machine having in successive engagement a dampening-pan roller, a metering roller and dampening-medium applicator rollers for forming a very thin uniform dampening-medium film comprising at least one brush roller cooperatively engaging and rolling on the metering roller, the brush-roller having absorptive brushes on the periphery thereof engageable with the surface of the metering roller for removing at least part of the dampening medium located in excessive quantities at any surface region of the metering roller.

An advantage of this construction is that, by contacting the bristles of the brush roller, minute quantities of dampening medium are removed from the metering roller and volatilize upon further rotation of the brush roller. This effect is achieved due to the multiplication of the surface of the removed dampening-medium film and the accelerated drying speed attained thereby. When a dampening-medium film of about 5 to 10 $\mu$m (microns) thickness, for example, is applied to the metering roller, the quantity of dampening medium normally removed by the brush roller is sufficient to reduce the excessive supply of dampening medium in the particular area or zone.

In accordance with another feature of the invention the at least one brush roller has a length which is only part of that of the metering roller, the brush roller being axially slidable and being throwable off the metering roller.

In accordance with a further feature of the invention the at least one brush roller has the same length as that of the metering roller and cooperates, within given zones with strippers for spraying back excessive dampening medium into a dampening-medium storage tank.

Through the use of short brush rollers a desired reduction in the dampening medium film thickness is possible. If the brush roller is provided with a length, however, which corresponds to that of the metering roller and is disposed in contact therewith, the feed of dampening medium must then be slightly increased in order to accommodate or make up for the natural evaporation of the dampening medium. Through suitable disposition of the strippers, the quantity of dampening medium can then be reduced likewise in specific areas.

In accordance with a concomitant an alternate feature of the invention, the strippers are formed as suction nozzles for sucking away excessive dampening medium. By using suction nozzles, the intense drying of the bristles produced thereby is sufficient to reduce the amount of dampening medium.

Other features which are considered as characteristic for the invention are set forth in the appended claims.

Although the invention is illustrated and described herein as embodied in a device for dampening a printing plate, it is nevertheless not intended to be limited to the details shown, since various modifications and structural changes may be made therein without departing from the spirit of the invention and within the scope and range of equivalents of the claims.

Figure 2:
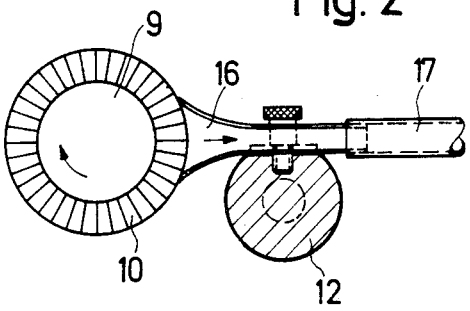

The construction and method of operation of the invention, however, together with additional objects and advantages thereof will be best understood from the following description of specific embodiments when read in connection with the accompanying drawings, in which:

FIG. 1 is a diagrammatic elevational view of one embodiment of the device for dampening a printing plate in a rotary printing machine according to the invention, and FIG. 2 is a fragmentary view of FIG. 1 showing another embodiment of an essential feature of the device, namely the means for removing excessive dampening medium from the brush roller thereof.

Referring now to the drawing and first particularly to FIG. 1 thereof, there is shown a conventional plate cylinder 1 on which a printing plate is clamped which is dampened primarily by applicator rollers 2 and 3. Both applicator rollers 2 and 3 are in mutual contact via an intermediate roller 4. The three rollers 2 to 4 thereby rotate at the same circumferential speed as that of the plate cylinder 1.

A metering roller 5 is in contact with the applicator roller 3 and is driven at a slower speed. The metering roller 5 has a hard, hydrophyllic surface and rolls with a dampening pan roller 6 which has an elastic surface. The dampening pan roller 6 revolves partly within dampening medium 7 contained in a dampening pan 8. The dampening medium entrained by the dampening pan roller 6 is metered between the latter and the metering roller 5 by the contact pressure therebetween so that a dampening-medium film only about 5 to 10 $\mu$m (microns) thick is present on the metering roller 5. By varying the circumferential speed of the metering roller 5, a greater or lesser quantity of dampening medium can be surrendered or transferred to the applicator roller 3, this being dependent upon the particular speed.

The metering roller 5 is operatively associated with and engages a brush roller 9 which, for example, rolls with the metering roller 5 at the circumferential speed thereof. The bristles 10 of the brush roller 9 thereby take up small quantities of dampening medium from the metering roller 5 and permit them to evaporate rapidly due to the increased surface thereof. The brush roller 9 can only engage along part of the length of the metering roller 5 in the illustrated embodiment of the invention and is mounted on levers 11 which are fastened to a traverse or crosspiece 12. The levers 11 are secured to a clamping member 18 and are both pivotable as well as laterally slidable therewith.

If the length of the brush roller 9 corresponds to the length of the metering roller 5, adjustable strippers or wipers 13 can then be provided at specific regions thereof for effecting the spraying off of the dampening medium from the brush roller 9. The sprayed-off dampening medium is fed back to the dampening medium 7 in the pan 6 by screens or diaphragms 14 and 15 which are fastened to the shiftable clamping member 18 by the levers 11. Instead of the strippers 13, as shown in FIG. 2, suction nozzles 16 can be used for sucking away the excess dampening medium and for evaporating the dampening medium by the suction action, respectively. The suction nozzles 16 are connected via a suction line 17 to a non-illustrated suction apparatus. The suction action is individually and differently adjustable for each of the suction nozzles 16 which are provided.

The foregoing is a description corresponding, in substance, to German application P 33 26 699.9, dated July 23, 1983, international priority of which is being claimed for the instant application, and which is hereby made part of this application. Any material discrepancies between the foregoing specification and the specification of the aforementioned corresponding German application are to be resolved in favor of the latter.

There is claimed:

1. A device for dampening a printing plate of a rotary printing machine having in successive engagement a dampening-pan roller, a metering roller and dampening-medium applicator rollers for forming a very thin uniform dampening-medium film comprising at least one brush roller spaced from the dampening-pain roller and cooperatively engaging and rolling on the metering roller, said brush-roller having absorptive brushes on the periphery thereof engageable with the surface of the metering roller for removing at least part of the dampening medium located in excessive quantities at any surface region of the metering roller.

2. Device according to claim 1, wherein said at least one brush roller has a length which is only part of that of the metering roller, said brush roller being axially slidable and being throwable off the metering roller.

3. Device according to claim 1, wherein said at least one brush roller has the same length as that of the metering roller and cooperates, within given zones, with strippers for spraying back excessive dampening medium into a dampening-medium storage tank.

* * * * *